United States Patent [19]
Bonazza et al.
[11] 4,230,588
[45] Oct. 28, 1980

[54] FUEL AND LUBRICANT ADDITIVES FROM AMINOALKYLALKANOLAMINES

[75] Inventors: Benedict R. Bonazza; Sidney Schiff, both of Bartlesville, Okla.

[73] Assignee: Phillips Petroleum Company, Bartlesville, Okla.

[21] Appl. No.: 938,575

[22] Filed: Aug. 31, 1978

[51] Int. Cl.[2] ..... C10M 1/32; C10M 1/38
[52] U.S. Cl. ..... 252/51.5 A; 252/47.5; 44/66; 44/58; 260/401; 260/402; 260/404.5
[58] Field of Search ..... 252/51.5 A, 47.5; 44/66, 58; 260/401, 402, 404.5

[56] References Cited

U.S. PATENT DOCUMENTS

| | | | |
|---|---|---|---|
| 3,169,980 | 2/1965 | Benoit | 260/404.5 |
| 3,630,904 | 12/1971 | Musser et al. | 252/51.5 A |

*Primary Examiner*—Paul F. Shavers

[57] ABSTRACT

Fatty acids are reacted with aminoalkylalkanolamines to form amide amine alcohols, multiamide-alcohols, or multiamide-esters that have good detergent properties in fuels and lubricants. In an embodiment of the invention reaction products in which all of the reactant nitrogen has not been amidated are further reacted with arylsulfonic acid to provide more water tolerant products.

12 Claims, No Drawings

FUEL AND LUBRICANT ADDITIVES FROM AMINOALKYLALKANOLAMINES

BACKGROUND OF THE INVENTION

This invention relates to additives for hydrocarbons suitable for use in an internal combustion engine. In one of its aspects this invention relates to detergent additives for hydrocarbon fuels. In another of its aspects this invention relates to detergent additives for hydrocarbon lubricants. In another of its aspects this invention relates to fuel detergent additives for use in hydrocarbon fuel and internal combustion engines. And yet another aspect of the invention relates to reaction products containing a plurality of different functional moieties combined to produce superior qualities for fuel detergents and lubricant detergents.

The use of hydrocarbon-soluble detergents prepared by the process of this invention is effective in minimizing or preventing the deposition of harmful deposits on the interior walls of the carburetor of the internal combustion engine. If allowed to accumulate, those deposits can cause enrichment of the fuel: air ratio which results in increased hydrocarbon and carbon monoxide emissions, reduced fuel economy, and driving problems such as rough idling and frequent stalling.

It is therefore an object of this invention to provide additive mixtures for internal combustion engine fuels and lubricants containing multiple detergent functionalities. It is another object of this invention to provide a method for producing detergent additives for internal combustion engine fuels and lubricants. It is still another object of this invention to provide a detergent fuel composition combining a fuel detergent additive with a hydrocarbon suitable for use as fuel in an internal combustion engine.

Other aspects, objects and the various advantages of this invention will become apparent upon reading the specification and the appended claims.

STATEMENT OF THE INVENTION

According to this invention, a hydrocarbon-soluble detergent suitable for use in the fuel of an internal combustion engine is made by reacting fatty acid with aminoalkylalkanolamine. The invention contemplates both the fuel additive and the method of preparation.

In another embodiment of the invention a hydrocarbon-soluble detergent having improved water tolerance is provided by reacting with arylsulfonic acid the reaction products described above in which all of the reactant nitrogen has not been amidated.

In the reaction of fatty acid with aminoalkylalkanolamine, depending upon the amine chosen and the molar ratio of acid to amine, the additive product will be an amide amine alcohol, a multiamide-alcohol, or a multiamide-ester.

These will hereinafter be referred to as amide product. In the fatty acid, RCOOH, R is a hydrocarbyl radical of about 7 to about 99 carbon atoms, preferably about 12 to about 33 carbon atoms. These hydrocarbyl radicals include alkyl, alkenyl, cycloalkyl, and aralkyl groups. Suitable examples are capric acid, myristic acid, stearic acid, oleic acid, phenylstearic acid, naphthyllauric acid, and the like.

Reactant aminoalkylalkanolamines have the general formula $H_{3-a}N(CH_2CH_2NR'CH_2CH_2OH)_a$ where R' is H or $CH_2CH_2NH_2$ and is a 1,2, or 3. Suitable examples are N-(2-aminoethyl)-2-aminoethanol, N,N-bis(2-aminoethyl)-2-aminoethanol, tris [N-(2-hydroxyethyl-)aminoethyl]amine, and the like.

Each primary nitrogen, secondary nitrogen, and carbinol group in the reactant amine can be reacted with the fatty acid(s) to form amide, amide, and ester, respectively. Since amidation and esterification are effected by elimination of a mole of water, determination of the quantity of water evolved from the reactants provides a criterion to determine how far the reaction has proceeded. It is presumed that, when the quantity of fatty acid is insufficient to react with all available functional groups, i.e., primary and secondary amines and carbinols, the amines are substantially completely amidated before esterification begins.

The reaction is carried out under conditions in which water is removed promptly. Solvents, such as liquid hydrocarbons, may provide the reaction medium or the reactants may be combined neat. Suitable hydrocarbon solvents for the reaction are preferably aromatics, but they may be paraffinic or naphthenic. Desirably, their boiling range is between 100°–250° C. so the reaction may be conducted under reflux conditions. Amidation and esterification reactions may occur at ambient temperature or below, but, to hasten completion of the reaction, it is preferable for the reaction to be performed at refluxing conditions with condensing of the refluxed solvent and separation and removal of the aqueous phase. When no solvent is used, evolved water vapor should be swept from the reactor; an inert gas, such as nitrogen, is suitable for purging the reactor. Although it is not required, use of an inert, oxygen-free, gas blanket is recommended during amidation to prevent undesirable oxidation reactions.

The amide product, provided that not all of the reactant nitrogen has been amidated, is reacted with an arylsulfonic acid to improve its water tolerance. Suitable sulfonic acids have the general formula $R''SO_3H$ where R'' is an aryl or an alkaryl group with 6 to 100 carbon atoms. Benzenesulfonic acid, dodecylbenzenesulfonic acid, or the acid oil product made by treating lubricating stock with sulfur trioxide are examples of suitable sulfonic acids. The ratio of sulfonic acid to amide product to prepare the finished additive can be determined by titrating them separately with standard base and standard acid, respectively, using a glass electrode pH meter. Samples are dissolved in titration solvent (equal volumes of benzene and isopropanol plus 0.5 volume percent water) for the titration. The quantity of sulfonic acid added to the amide product should produce material having pH of about 7–8. The reaction is effected by combining pre-determined quantities of sulfonic acid and the amide product, warming to 50°–70° C. for 15 to 30 minutes, with stirring to produce a homogeneous phase. Viscous reactants may conveniently be thinned by dilution with lubrication stock or other solvents to facilitate their mixing.

These amide products or their derivatives that have been neutralized (with sulfonic acid) are detergent additives that are added to motor fuel in the concentration range of about 1–100 pounds/1000 barrels, preferably about 5–30 pounds/1000 barrels, to prevent harmful carburetor and fuel intake system deposits.

These additives are also useful when added to lubricating stock. They serve as detergents to keep engine parts clean. Other additives, such as viscosity index improvers, antioxidants, and the like, can be used in formulation with the additives of this invention.

The following examples illustrate preparations and evaluations of additives of this invention.

EXAMPLE 1

The amide amine alcohol resulting from reaction between equimolar quantities of phenylstearic acid and N-(2-aminoethyl)-2-aminoethanol was prepared by combining 74.6 gm (0.20 moles) of the former with 20.8 gm (0.20 moles) of the latter plus about 20 ml of toluene. These were heated to reflux (about 130° C.) in a flask fitted with a condenser, a Barrett water trap, a thermowell for temperature observation and controlling, and a magnetic stirrer. A slow stream of nitrogen, introduced via a tube in the condenser, maintained an inert atmosphere in the reactor. During two hours of refluxing, the stoichiometric quantity of water was collected. The phenylstearamide of N-(2-aminoethyl)-2-aminoethanol produced, dissolved in toluene, was cooled. Analysis of the solution by potentiometric titration with standard acid showed it to contain 0.239 equivalents of basic nitrogen. A portion of this product was freed from solvent in a rotary evaporator for subsequent evaluation as an additive.

EXAMPLE 2

A portion representing 30 percent (0.072 equivalents) of the solution made in Example 1 was reacted with 20 gm of acid oil which was made by sulfonating lubricating base stock with sulfur trioxide; the equivalent weight of the acid oil was 1290. This quantity of acid oil was chosen because its product with the amide from Example 1, when diluted with titration solvent, had a pH of 7.5. After removal of solvent, the product was evaluated as an additive.

EXAMPLE 3

A portion representing 22 percent (0.053 equivalents) of the solution made in Example 1 was reacted with 9.4 gm (0.029 equilvalents) of dodecylbenzene sulfoncic acid—Witco Chemical's Sulframin 98 Hard Acid. After removal of solvent the product was evaluated as an additive. The product, as a 0.1 percent solution in titration solvent, had a pH of 7.8.

EXAMPLE 4

The composition of this example, a multiamide alcohol, made by reacting a ratio of two moles of phenylstearic acid per mole of N-(2-aminoethyl)-2-aminoethanol, was prepared by two different methods.

A. 149.2 gm (0.40 moles) of phenylstearic acid and 20.8 gm (0.20 moles) of N-(2-aminoethyl)-2-aminoethanol, with about 25 ml of toluene solvent, in a reaction flask fitted as described in Example 1, were allowed to reflux for about 1.7 hours at 130°–155° C. The stoichiometric quantity of water (0.40 moles) was formed and collected during this interval. Infrared analysis of the product made in this synthesis showed it to contain a substantial concentration of imidazoline in addition to the diamide that was sought.

B. Quantities of the two reactants identical to those used in part A (above) were placed in a reactor without any solvent. The reactor bore a thermowell for temperature measurement and control, an opening through which a purging flow of nitrogen gas was introduced and a condenser cooled with ice water that permitted collection and measurement of evolved water after it had left the reactor. In 4.5 hours at about 150° C., the stoichiometric quantity of water was formed and collected. Infrared analysis of this product showed it to contain much less imidazoline than that from part A—the product was principally a multiamide.

EXAMPLE 5

Products from three different fatty acids reacting with N-(2-aminoethyl)-2-aminoethanol in 3:1 mole ratio were prepared.

A. In a reactor equipped as described in Example 1, 149.2 gm (0.40 moles) of phenylstearic acid and 13.9 gm (0.113 miles) of N-(2-aminoethyl)-2-aminoethanol, plus about 25 ml toluene as solvent, were heated for two hours at 150°–175° C., at which time 90 percent of the stoichiometric quantity of water had been collected in the Barrett water trap. Solvent was removed from the reaction product in a rotary evaporator during two hours at about 80° C., 0.1 torr pressure. The resulting product was evaluated as an additive.

B. In a reactor fitted as above, 56.8 gm (0.20 moles) of stearic acid, 37.3 gm (0.10 mole) of phenylstearic acid, and 10.4 gm (0.10 mole) of N-(2-aminoethyl)-2-aminoethanol plus about 25 ml of toluene as solvent, were heated. During 2.6 hours' refluxing at 145°–150° C., about 70 percent of the stoichiometric quantity of water was collected. By removing solvent via the water trap, the reflux temperature was raised to about 180°–190° C.; during another three hours at that temperature. 100 percent of the stoichiometric quantity of water was collected. The remaining solvent was then removed with a rotary evaporator and the resulting product was evaluated as an additive.

C. In a reactor fitted as above were placed 84.6 gm (0.30 moles) of tall oil acid (Acintol FA-3 from Arizona Chemical Co.) and 10.4 gm (0.10 mole) of N-(2-aminoethyl)-2-aminoethanol, plus about 50 ml of toluene as solvent. During 1.5 hours of refluxing at 140°–145° C., about 65 percent of the stoichiometric quantity of water had been collected. Raising the boiling point by removing some solvent and continuing to heat, as 180°–190° C., for another four hours produced about 95 percent of the theoretical amount of water. Some solvent was removed in a rotary evaporator, the balance by heating for about 1.2 hours at 150° C. and about 1 torr pressure. The resulting product was evaluated as an additive.

EXAMPLE 6

Additives whose preparation is described in the preceding examples were subjected to a series of tests in gasoline at the concentrations listed.

1. Falcon engine test: 10 pounds/1000 barrels. (All additives containing acid oil were tested at 20 pounds/1000 barrels.)
2. Thin layer chromatography (TLC) test for detergency: 6.3 weight percent additive.
3. Spray gum deposit: 0.07 weight percent additive or 175 pounds/1000 barrels.

The Falcon engine test, briefly, involves use of the test gasoline in a 170 cubic inch displacement, 6-cylinder automobile engine with a removable carburetor throat insert. The engine operated for 23 hours at 1800 rpm and 11.4 brake horsepower. The difference in insert weight before and after the test, after washing it with n-heptane, gives the weight of deposit formed. Results are compared with tests using a base gasoline which was commercial leaded gasoline and are expressed as the percentage by which the mass of deposit from the base gasoline was reduced by the additive being tested.

The TLC test for detergency provides a basis for evaluating potential carburetor detergents in a much shorter period of time than the Falcon engine test requires. It involves use of a toluene solution of the additive being tested to move a small portion of a carburetor deposit in a developing paper chromatogram. Results are reported as follows:

| Numerically | Verbally | Description |
|---|---|---|
| 4 | Poor | Deposit remains with no or very little movement. |
| 6 | Fair | About half of deposit is removed and Carried upwards; possible streaking full length of solvent movement. |
| 8 | Good | Much of deposit moves with solvent front, or close to it; only a small part of it remains at origin. |
| 9 | Good - Excellent | Deposit is completely moved and essentially moves with solvent front. |

This test was developed to screen additives without using the time that engine tests require. Additives that fail this test always fail the engine test, but those that pass it should be confirmed by engine test data. A rating of 4 is considered to be a failure.

The spray gum deposit test provides a measure of the thermal stability of the additive being evaluated. The test is carried out by spraying 250 ml of gasoline containing the additive and 0.04 weight percent Santolube 395-X (a sulfurized terpene, to augment gum formation) into a tare aluminum pan maintained at 191° C. After spraying has ended the pan is cooled, washed in n-heptane, dried, and reweighed. Test results are reported as the gain in weight, in milligrams, per 250 ml gasoline.

Results of tests on the additives of this invention are summarized in the following tabulation:

| Additive from Example | Composition* Molar Ratios | Falcon Engine | TLC | Spray Gum |
|---|---|---|---|---|
| 1 | PS: AEAE | 39 | 9 | 0.0 |
| 2 | PS: AEAE : 0.3A0 | 73 | 9 | 0.0 |
| 3 | PS: AEAE : 0.6DBSA | 65 | 8 | 0.0 |
| 4A | 2PS: AEAE (with solvent) | 69 | 8 | N.D.** |
| 4B | 2PS: AEAE (without solvent) | 84 | 8 | N.D. |
| 5A | 3PS: AEAE | 70 | 6 | N.D. |
| 5B | PS+ 2 SA : AEAE | 53 | 5 | N.D. |
| 5C | 3TOA: AEAE | 49 | 5 | 0.1 |

*PS = phenylstearic acid, SA = stearic acid, TOA = tall oil acid, AO = acid oil, DBSA = dodecylbenzenesulfonic acid, AEAE = N-(2-aminoethyl)-2-aminoethanol
**Not Determined Of the additives synthesized, only Example 1 is amenable to neutralization with sulfonic acid. As explained above, the others are already completely amidated. Comparison of the results on Examples 1, 2, and 3 shows that the latter two, which had been quaternized, are markedly superior to the unreacted product. Comparison of additives 4A and 4B suggests that the product prepared neat is superior to that using solvent. Examples 5A, 5B, and 5C are not only completely amidated but the carbinol group has also been esterified. Results of the Falcon engine tests indicate that the hydroxyl function may be superior to the ester function in detergency.

We claim:

1. A method for producing detergent additives for lubricants and fuels comprising reacting fatty acid represented by the formula RCOOH in which R is a hydrocarbyl radical of about 7 to about 99 carbon atoms with aminoalkanolamine represented by the formula $H_{3-a}N(CH_2CH_2NR'CH_2CH_2OH)_a$ where R' is H or $CH_2CH_2NH_2$ and a is 1, 2, or 3.

2. A method of claim 1 wherein the fatty acid is chosen from among capric acid, myristic acid, stearic acid, oleic acid, phenylstearic acid, and naphthyllauric acid.

3. A method of claim 1 wherein the aminoalkylalkanolamine is chosen from among N-(2-aminoethyl)-2-aminoethanol, N,N,-bis(2-aminoethyl)-2-aminoethanol, and tris[N-(2-hydroxyethyl)aminoethyl]amine.

4. A detergent additive for lubricants and fuels produced by the method of claim 1.

5. A method for producing a detergent additive for lubricants and fuels comprising further reacting the reaction product made by the method of claim 1 with an arylsulfonic acid.

6. A detergent additive for lubricants and fuels produced by the method of claim 5.

7. A composition comprising hydrocarbons suitable as fuel in an internal combustion engine and a compound of claim 5, said compound of claim 4 present in an amount effective as a fuel detergent additive.

8. A composition comprising a lubricating oil and a compound of claim 4, said compound of claim 5 present in an amount effective as a lubricating oil additive.

9. A composition comprising hydrocarbons suitable as fuel in an internal combustion engine and a compound of claim 6, said compound of claim 7 present in an amount effective as a fuel detergent additive.

10. A composition comprising a lubricating oil and a compound of claim 6, said compound of claim 6 present in an amount effective as lubricating oil additive.

11. A method for reducing engine deposits in an internal combustion engine comprising the addition of a fuel detergent additive of claim 4 to the hydrocarbon fuel for the engine, said fuel detergent being added in an amount effective to reduce engine deposits and using said hydrocarbon fuel detergent additive as fuel in an internal combustion engine.

12. A method for reducing engine deposits in an internal combustion engine comprising the addition of a detergent fuel additive of claim 6 to the hydrocarbon fuel for the engine, said fuel detergent being added in an amount effective to reduce engine deposits and using said hydrocarbon fuel with fuel detergent additive as fuel in an internal combustion engine.

* * * * *